United States Patent [19]

Johnson, Jr. et al.

[11] 4,101,043

[45] Jul. 18, 1978

[54] CONTAINER AND SUPPORT CLIP COMBINATION

[75] Inventors: Joseph E. Johnson, Jr., East Lyme; Richard D. Warrell, Mystic, both of Conn.

[73] Assignee: Monsanto Company, St. Louis, Mo.

[21] Appl. No.: 832,255

[22] Filed: Sep. 12, 1977

[51] Int. Cl.[2] ..... B65D 25/22

[52] U.S. Cl. ..... 215/100 R; 222/181; 248/311.3; 248/359

[58] Field of Search ..... 215/100 R; 222/181; 4/227; 248/311.3, 359, 360

[56] References Cited

U.S. PATENT DOCUMENTS

| | | | |
|---|---|---|---|
| D. 223,102 | 3/1972 | Purcell | D9/10 |
| D. 232,157 | 7/1974 | Jacobs | D9/10 |
| D. 242,018 | 10/1976 | Gargione | D9/10 |
| 3,627,177 | 12/1971 | Marcus | 222/181 |
| 3,698,021 | 10/1972 | Mack | 4/227 |
| 3,768,684 | 10/1973 | Buchtel | 215/100 R |
| 3,998,360 | 12/1976 | Mack | 222/181 |

*Primary Examiner*—Donald F. Norton
*Attorney, Agent, or Firm*—Michael J. Murphy

[57] ABSTRACT

In the combination of a container for automatically dispensing a cleaner or disinfectant into a toilet reservoir on which such container is supported via a clip member slidable in a recess in the container base between storage and dispensing positions, the improvement wherein the slidable clip porton and the walls of such recess are provided with means locking the clip against movement when in each of such positions.

5 Claims, 3 Drawing Figures

CONTAINER AND SUPPORT CLIP COMBINATION

BACKGROUND OF THE INVENTION

This invention relates to dispensing containers and more particularly to the combination of a container for automatically dispensing its contents and an integrally attached clip for supporting it in inverted dispensing position.

Many compositions are sold for treatment of water in a toilet reservoir and are usually provided in a container which has a dispensing mechanism adapted to automatically discharge measured portions of liquid in response to varying levels in the toilet reservoir. Such containers are usually fitted with a hanging device which suspends the container in a bottom-up position on the wall of the reservoir. Typical of such packages are those disclosed in U.S. Pat. No. 3,698,021, col. 2, lines 28–53, the contents of which is incorporated herein by reference to explain one manner of dispensing such compositions.

SUMMARY OF INVENTION

An object of this invention is to provide a support clip for cooperation with a container adapted to dispense in an inverted position, wherein the container may be formed of conventional thermoplastic materials and is without any critical tolerances in the portion cooperating with the support clip.

Another object is to provide an easily molded support clip for a dispensing container which self-locks to the container in two positions, one for shipment until use is contemplated and the other for contents-dispensing during such use.

Other objects of this invention will in part be obvious and will in part hereinafter from the following description and claims.

These and other objects are accomplished in the combination of a container and an L-shaped support clip operable in a recess in the container base by providing the improvement wherein such clip comprises an upright portion substantially parallel to the container axis and a forked base portion slidable in the recess between first and second positions at which the upright member is respectively displaced outwardly of and substantially in surface engagement with a sidewall of such container, the bifurcations of such forked member and the walls of such recess having means to lock the clip in place in such first position.

BRIEF DESCRIPTION OF THE DRAWING

In describing the overall invention, reference will be made to the accompanying drawing wherein.

DETAILED DESCRIPTION OF THE ILLUSTRATED EMBODIMENT

Figure 1:
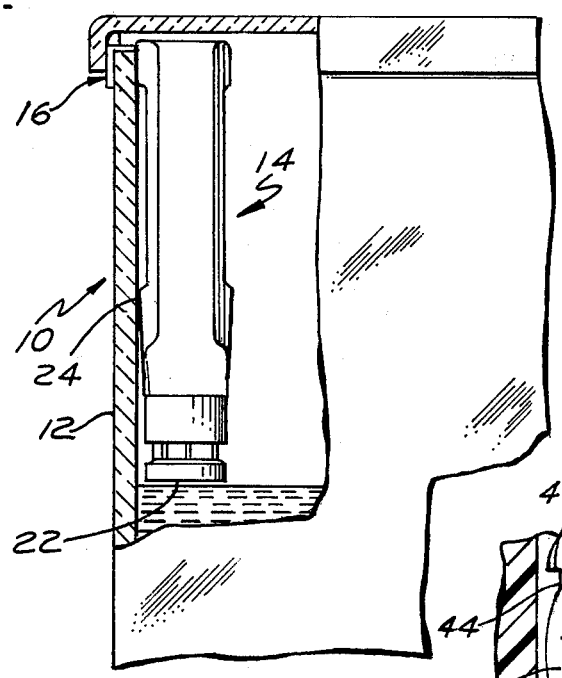
FIG. 1 is a partial, sectional view of a toilet reservoir supporting a dispensing container and improved support clip of the invention.
Figure 2:
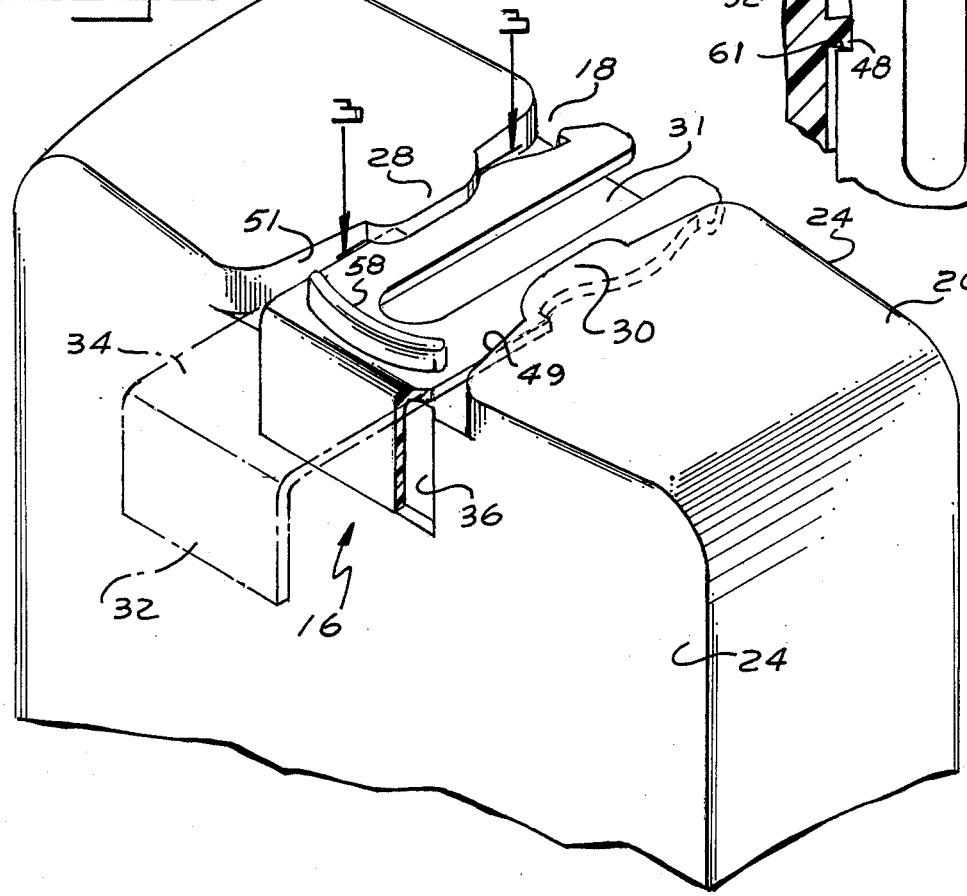
FIG. 2 is a partial, enlarged perspective view of a support clip and cooperating container base wall of the invention showing the dual positions of the support clip of FIG. 1.

Referring now to the drawing, package assembly 10 is shown in FIG. 1 mounted on sidewall 12 of a toilet reservoir and comprises container 14 mounted in an inverted position, and integral L-shaped support clip 16 slidably operable in recess 18 (FIG. 2) in container base 20. Container 14 has a discharge opening 22 at one end through which may exit a water treatment composition in the manner, for example, disclosed in U.S. Pat. No. 3,698,021, col. 2, lines 28–53. Though container 14 may be of any shape, oval is preferred in order that either of a pair of opposed planar sidewalls 24 may abuttingly engage a vertical wall of a supporting toilet reservoir.

Recess 18 in container base 20 is relatively shallow and forms a guideway for reciprocable movement of base portion 34 of clip 16 therein. Recess 18 extends across the width of base 20 between opposing walls 24 and is provided centrally of its ends with lugs 28, 30 overhanging track portion 31 in which base portion 34 is slidable. Lugs 28, 30 prevent portion 34 from upwardly exiting track 31 during reciprocable movement of clip 16.

Clip 16 which is integrally attached to container 14 is preferably one-piece, is formed of a resilient material such as a conventional thermoplastic resin and comprises upright portion 32 lying in a vertical plane substantially parallel to the longitudinal axis of container 14 when clip 16 is fitted thereto. Forked base portion 34 of clip 16 extends substantially at 90° to portion 32 and is slidably and reciprocably received in track 31 of recess 18 between a first position at which upright portion 32 is outward of a sidewall 24 and a second position at which portion 32 is in substantially abutting engagement with such a sidewall. A vertical recess 36 substantially conforming in shape to that of clip portion 32 is preferably formed in each sidewall 24 adjacent base 20 to receive clip portion 32 when the latter is in its retracted second position regardless of which container side such portion 32 may be disposed opposite.

Figure 3:
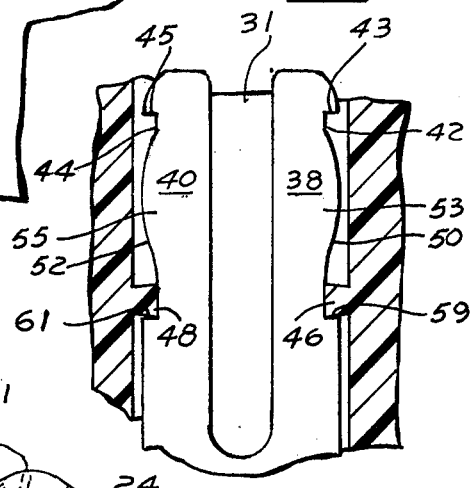
FIG. 3 is a sectional view along 3—3 of FIG. 2.

Base portion 34 has dual prongs or bifurcations 38, 40 which in combination with the walls of recess 18 are provided with means to releasably lock clip 16, and specifically upright portion 32, in place in the first container-supporting position of FIG. 1. Such means in the illustrated embodiment comprise indentations 42, 44 formed along bifurcations 38, 40 defining forward abutment edges 43, 45 plus a set of bosses 46, 48 (FIG. 3) projecting from vertical walls 49, 51 of recess 18 midway between the ends thereof, and below lugs 28, 30. The walls defining indentations 42, 44 each bulge outwardly at 53, 55 toward bosses 46, 48 (FIG. 3) and are curved in plan view. When clip 16 is urged linearly outwardly, for example via finger pressure exerted on ridge 58, rigid bosses 46, 48 camingly slide along faces 50, 52 while yieldable bifurcations 38, 40 convergingly more toward each other until bosses 46, 48 enter the forward portions of indentations 42, 44 at which point resilient prongs 38, 40 snap divergently outward and, along with forward abutment edges 43, 45, trap bosses 46, 48 in the forward portion of such indentations. Further outward displacement of clip 16 is prevented via engagement of the bosses with edges 43, 45 of the slots and thus the undesirable possibility of pulling the clip completely out of the slot in preparing the package for use is avoided.

Prongs 38, 40 are preferably provided also with means cooperating with the walls of recess 18, and specifically with lugs 46, 48, to releasably lock the clip in place in its second storage position (shown in solid lines in FIG. 2) prior to installation on the toilet reservoir. Such additional means comprises the rearward portions of bulges 53, 55 in a direction toward clip portion 32 which cooperate with lugs 46, 48 in the same manner as described with respect to the extended position of clip 16 to prevent sliding gravity movement of the clip out of the slot and in cooperation with rear edges 59, 61, hold it in place until it is desired to move clip 16 outwardly into container supporting position. In this manner, the attractive integrity of the package is maintained during shipment and storage on a retailer's shelf with the upright portion 32 snugly seated within sidewall recess 36.

The above description and particularly the drawing is set forth for purposes of illustration only and is not to be taken in a limited sense. Various modifications and alterations will be readily suggested to persons skilled in the art. It is intended, therefore, that the foregoing be considered as exemplary only and that the scope of the invention be ascertained from the following claims.

What is claimed is:

1. In the combination of a container and an L-shaped support clip operable in a recess in the container base, the improvement wherein said clip comprises:

(a) an upright portion substantially parallel to the container axis; and (b) a forked base portion slidable in the recess between first and second positions at which the upright member is respectively displaced outwardly of and substantially in surface engagement with a sidewall of such container, the bifurcations of said forked member and the walls of such recess having means to lock the clip in place in said first position.

2. The combination of claim 1 wherein said bifurcations have means cooperating with the walls of the recess to lock the clip in place in said second position.

3. The combination of claim 2 wherein said means to lock the clip in the second position comprise second cooperating indentations and projections on said bifurcations and recess walls.

4. The combination of claim 1 wherein said means comprise a first set of cooperating indentations and projections on said bifurcations and recess walls.

5. A support clip for a container comprising an L-shaped element having an upright portion and a resilient, forked base portion adapted to be slidably mounted on the container for limited movement between two positions, one at which the L-shaped element substantially conforms to the contour of the container, the other at which the upright portion is displaced outwardly from the side of the container so that the article upon which the container is to be supported may be engaged therebetween, the bifurcations of said forked base portion having means cooperable with a slot in the container for self-locking the support clip against movement when in place in each of said positions.

* * * * *